US011817277B2

(12) United States Patent
Rodriguez

(10) Patent No.: US 11,817,277 B2
(45) Date of Patent: Nov. 14, 2023

(54) APPARATUS AND A DEVICE FOR EXTENDING MULTIPLE TYPE ELECTRICAL SWITCHES

(71) Applicant: Joaquin Rodriguez, San Juan, TX (US)

(72) Inventor: Joaquin Rodriguez, San Juan, TX (US)

( * ) Notice: Subject to any disclaimer, the term of this patent is extended or adjusted under 35 U.S.C. 154(b) by 475 days.

(21) Appl. No.: 15/934,511

(22) Filed: Mar. 23, 2018

(65) Prior Publication Data

US 2019/0295786 A1 Sep. 26, 2019

(51) Int. Cl.
*H01H 23/14* (2006.01)
*H01H 3/02* (2006.01)
*H01H 9/02* (2006.01)

(52) U.S. Cl.
CPC ..... *H01H 3/02* (2013.01); *H01H 23/141* (2013.01); *H01H 9/02* (2013.01); *H01H 2221/016* (2013.01); *H01H 2221/058* (2013.01); *H01H 2223/024* (2013.01)

(58) Field of Classification Search
CPC ..... H01H 23/141
See application file for complete search history.

(56) References Cited

U.S. PATENT DOCUMENTS 2,493,581 A * 1/1950 Hood ..... H01H 23/141 74/503
3,077,789 A * 2/1963 De Lashmutt ..... H01H 23/141 74/503
3,916,134 A * 10/1975 Hansen ..... H01H 23/141 200/331
4,745,243 A * 5/1988 Wang ..... H01H 17/08 200/330
9,406,464 B2 * 8/2016 Montano ..... H01H 23/141

* cited by examiner

*Primary Examiner* — Felix O Figueroa
(74) *Attorney, Agent, or Firm* — Anthony T. Whittington

(57) ABSTRACT

A device for extending one or more electric switches is provided. The device may include: an extension rod for actuating the electric switches; a front plate for keeping the extension rod aligned during actuation of the electric switches; and a fastener portion for securely attaching the front plate to a wall mount plate corresponding to the electric switches. Further, the extension rod may include a switch actuator portion implemented as a single structure that is configured to actuate a rocker switch and a toggle switch.

19 Claims, 6 Drawing Sheets

APPARATUS AND A DEVICE FOR EXTENDING MULTIPLE TYPE ELECTRICAL SWITCHES

CROSS-REFERENCES TO RELATED APPLICATIONS

N/A.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD OF THE TECHNOLOGY

The present disclosure generally relates to the field of electrical wall switch installations and, more specifically, to an apparatus and a system for extending multiple types of light switches.

DESCRIPTION OF THE RELATED ART

Wall-mounted electrical switches are commonly utilized in residential and other building structures to allow persons to activate electric lighting, ceiling fans, air conditioning systems or other electrical appliances. Often, wall-mounted electrical switches are configured and positioned in a manner that makes use of the switches difficult or nearly impossible for children or physically challenged persons to utilize.

Various switch adapters, extenders, and actuators have been developed to facilitate the use of wall mounted electrical switches. However, the current known switch adapter and switch extender technologies suffer many deficiencies. In particular, the current known switch extender technologies have been designed primarily for use with conventional toggle switches, rocker-type electric switches, or slider electric switches. However, none of these technologies allows for extending multiple types of electrical switches in one solution.

Therefore, what is needed is an apparatus and a device for extending multiple types of light switches.

SUMMARY

In an embodiment, a device for extending one or more electric switches is provided. The device may include: an extension rod for actuating the electric switches; a front plate for keeping the extension rod aligned during actuation of the electric switches; and a fastener portion for securely attaching the front plate to a wall mount plate corresponding to the electric switches, wherein the extension rod has a switch actuator portion implemented as a single structure that is configured to actuate a rocker switch and a toggle switch.

In yet another embodiment, an apparatus for extending one or more electric switches is provided. The apparatus may include: an extension rod for actuating the electric switches; a front plate for keeping the extension rod aligned during actuation of the electric switches; and a fastener portion for securely attaching the front plate to a wall mount plate corresponding to the electric switches, wherein the extension rod has a switch actuator portion implemented as a single structure that is configured to actuate a rocker switch and a toggle switch.

In still another embodiment, a switch actuating device for extending one or more electric switches is provided. The switch actuating device may include an extension rod for actuating the electric switches; a front plate for keeping the extension rod aligned during actuation of the electric switches; and a fastener portion for securely attaching the front plate to a wall mount plate corresponding to the electric switches, wherein the extension rod has a switch actuator portion implemented as a single structure that is configured to actuate a rocker switch and a toggle switch.

BRIEF DESCRIPTION OF THE DRAWINGS

The present invention is described in detail below with reference to the attached drawing figures, which are incorporated by reference herein and wherein.

DETAILED DESCRIPTIONS

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent application, which would still fall within the scope of the claims.

It should also be understood that, unless a term is expressly defined in this patent using the sentence "As used herein, the term ' ' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent application (other than the language of the claims). To the extent that any term recited in the claims at the end of this patent application is referred to in this patent application in a manner consistent with a single meaning, that is done for sake of clarity only so as to not confuse the reader, and it is not intended that such claim term by limited, by implication or otherwise, to that single meaning Finally, unless a claim element is defined by reciting the word "means" and a function without the recital of any structure, it is not intended that the scope of any claim element be interpreted based on the application of 35 U.S.C. § 112, sixth paragraph.

Figure 1:
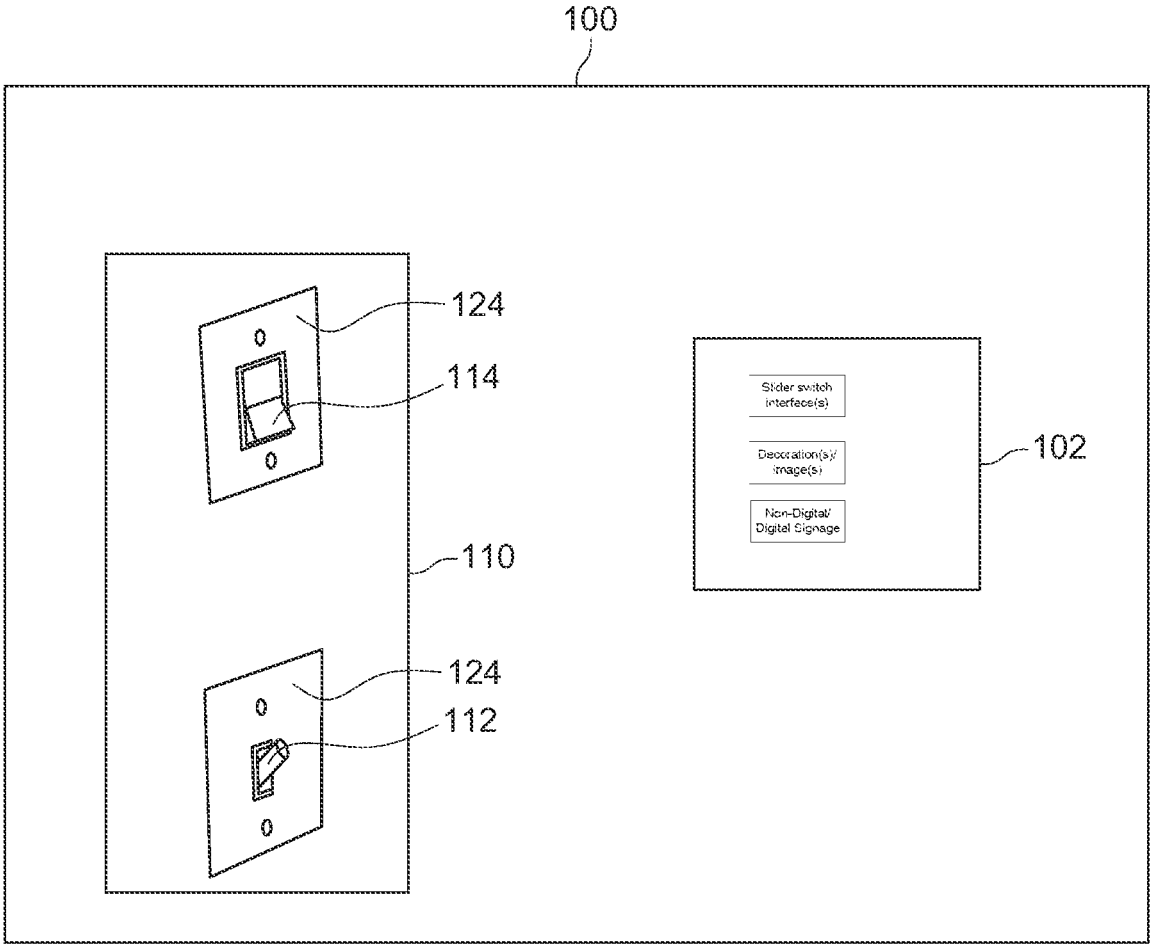
FIG. 1 is the switch extender system in accordance with an exemplary embodiment of the invention.

FIG. 1 illustrates a switch extender system 100 in accordance with an exemplary embodiment of the invention. As shown in FIG. 1, the switch extender system 100 may include a switch extender device 102 shown in connection with a conventional wall mounted light switch 110. In some implementations, the light switch 110 may include a wall-mounted plate 124, a toggle switch 112, a rocker switch 114, and a slider switch (not shown).

Figure 2:
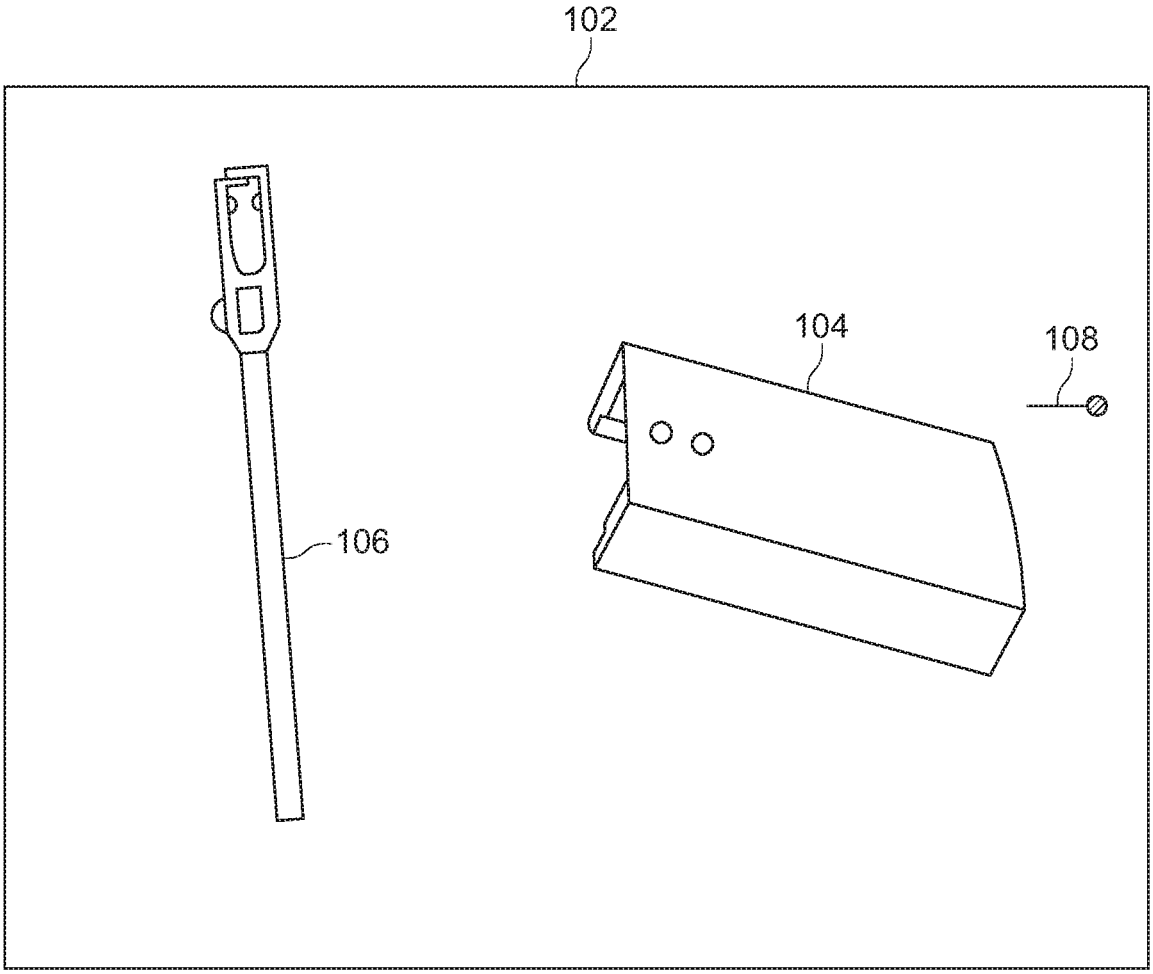
FIG. 2 is the system extender device in accordance with another exemplary embodiment of the invention.

FIG. 2 illustrates a switch extender device 102 in accordance with another exemplary embodiment of the invention. As shown in FIG. 2, the switch extender device 102 may include a front plate 104, an extension rod 106, and a fastener portion 108. In some embodiments, the fastener portion 108 may be depicted as a screw or a nail.

Figure 3A:
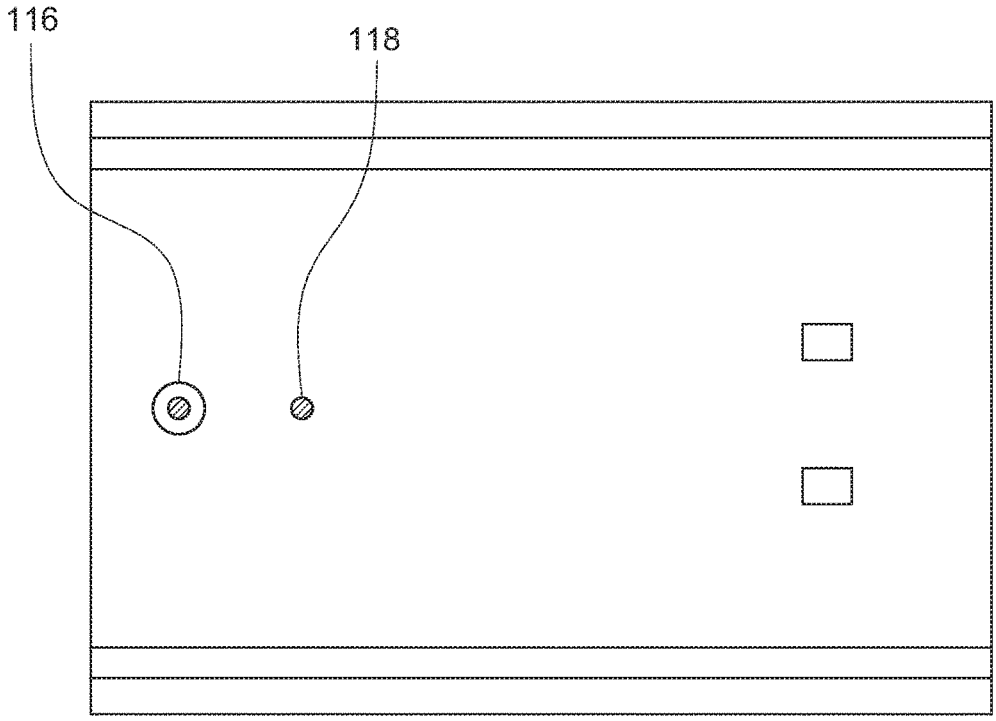
FIG. 3A is the front side of the front plate in accordance with an exemplary embodiment of the invention.
Figure 3B:
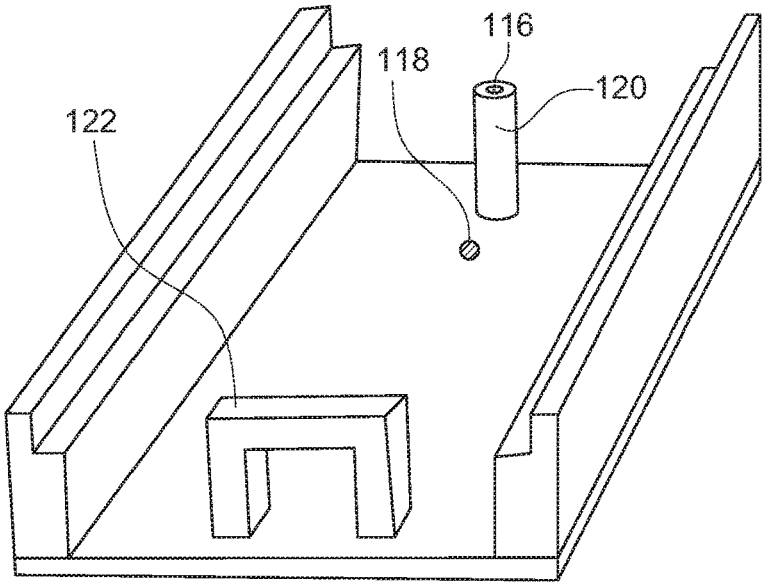
FIG. 3B is the back side of the front plate in accordance with an exemplary embodiment of the invention.

FIGS. 3A and 3B illustrate the front plate 104 in accordance with exemplary embodiments of the invention. As shown in FIG. 3A, the front plate 104 may include one or more apertures or openings. In some embodiments, the front plate may include non-elongated aperture 116 and elongated aperture 118. As shown in FIG. 3B, the elongated aperture 118 may provide access to the fastener portion 108 to mount the front plate 104 to the wall-mounted plate 124 of the light switch 110.

In another embodiment, the elongated opening 118 may be covered by a covering or a sleeve 120. The covering 120 may be included in association with a bore (not shown) to control the amount of sliding motion of the front plate 104 so that front plate 104 does not inadvertently slide off the wall-mounted plate 124 during use of the switch extender device 102. In other words, the covering 120 acts as a barrier to surround or to encapsulate the elongated aperture 118 to prevent motion of the front plate 104 further than allowed by the length of the aperture 118.

Further, in FIG. 3B, the front plate 104 may include a guard rail 122 to keep the extension rod 106 aligned properly in the displacement path to toggle the light switch 110 on and off and prevent the extension rod 106 from falling out of the displacement path of the front plate 104. In some embodiments, the front plate 104 may be removably attached, slidably coupled, partially affixed, or completed affixed to the wall-mounted plate 124 of the light switch 110 by the fastener portion 108. In another embodiment, the guard rail 122 may be rectangular, circular, or any known shape known by those skilled in the art.

The fastener portion 108 may be used for coupling the front plate 104 to the wall-mounted plate 124 of the light switch 110. In an embodiment, the fastener portion 108 may include one or more bolts, screws, or any fastener portion known by those skilled in the art. The fastener portion 108 may be used to engage bores (not shown) in the front plate 104 and bores (not shown) in the wall-mounted plate 124 in a conventional manner to fasten, attach, secure, or affix the two plates to each other.

Figure 4A:
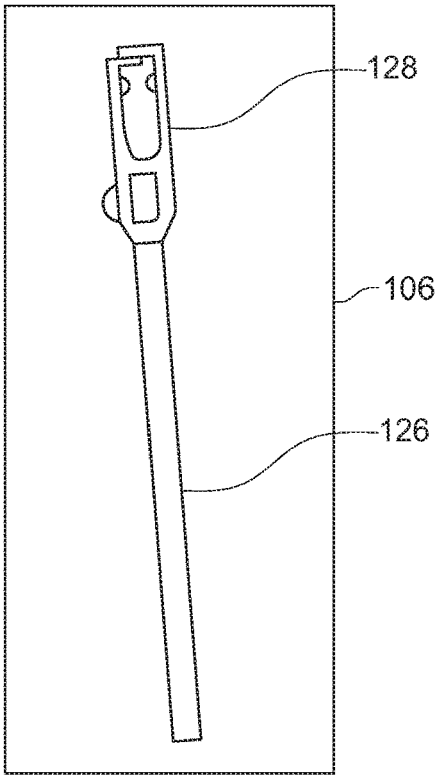
FIG. 4A is the rocker switch version of the extension rod in accordance with an exemplary embodiment of the invention.
Figure 4B:
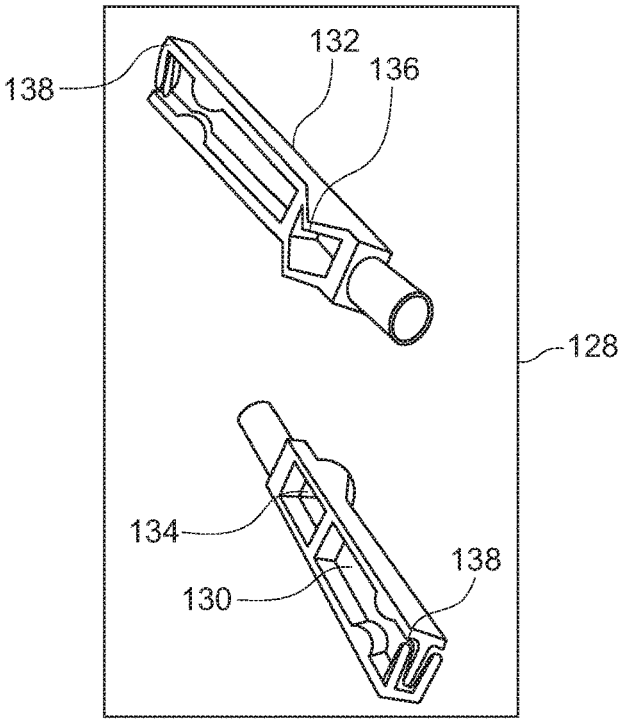
FIG. 4B is the toggle switch version of the extension rod in accordance with an exemplary embodiment of the invention.

FIGS. 4A and 4B illustrate the extension rod 106 in accordance with exemplary embodiments of the invention. As shown in FIG. 4A, the extension rod 106 may include a hand grip portion 126 and a switch actuator portion 128. The hand grip portion 126 may be used for assisting a user to grip the extension rod 106 and to facilitate the toggling of the light switch 110 on and off. The switch actuator portion 128 interfaces with the light switch 110 by facilitating the actuator motion with the light switch 110 to move the light switch 110 to an on and off position. In one embodiment, the extension rod 106 may be one or more discrete units, members, portions, or devices. In other embodiments, the extension rod 106 may be one or more separable portions, units, or members such that the hand grip 126 portion and the switch actuator portion 128 are detachable from and/or rejoinable to each other. In other words, the additional hand grip portions and switch actuator portions may be mixed and/or matched to form different extension rods.

In FIG. 4B, the switch actuator portion 128 has a front side 130 and a back side 132 to facilitate the actuation of different types of light switches. The front side 130 has a toggle switch interface 134 for actuating toggle switches. The back side 132 has a rocker switch interface 136 for actuating rocker switches. In another embodiment, the switch actuator portion 128 may be a slider switch interface (not shown) for actuating slider switches. Further, the switch actuator portion 128 may include a toggle distance barrier portion 138. The toggle distance barrier portion 138 prevents the extension rod 106 from inadvertently falling out of front plate 104 because the barrier 138 makes contact with the covering 120 of elongated aperture 118 after the light switch has been actuated. In one embodiment, the toggle distance barrier portion 138 may be a continuous, solid wall barrier that may be opened or closed. In another embodiment, the toggle distance barrier portion 138 may be continuous, a mesh or a net surface wall barrier that may be opened or closed. In yet another embodiment, the extension rod 106 may be a switch actuator portion 128 implemented as or designed as a single structure that is configured to actuate and/or interface with one or more rocker switches 114 and one or more toggle switches 112.

Figure 5:
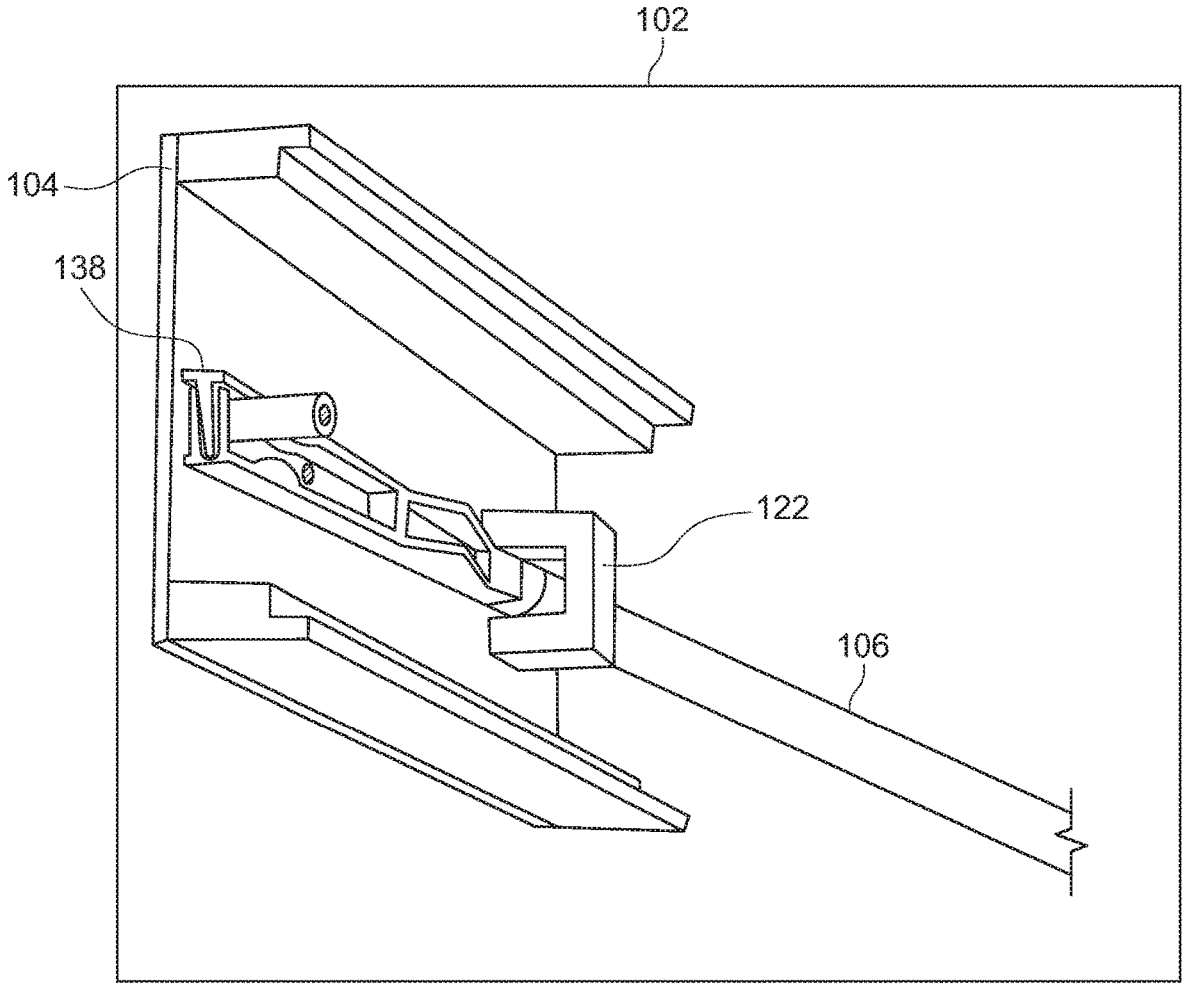
FIG. 5 is the switch extender device being operated in accordance with an exemplary embodiment of the invention.

FIG. 5 illustrates the switch extender device 102 being operated in accordance with an exemplary embodiment of the invention. As shown in FIG. 5, the switch extender device 102 may be utilized by a user slidably engaging or moving the extension rod 106 through the guard rail 122 of the front plate 104 in an up or down manner until the light switch toggles on or off Because of the distance barrier 138, the extension rod 106 stays in position until a user chooses to grip the extension rod 106 and actuate the light switch again.

Figure 6:
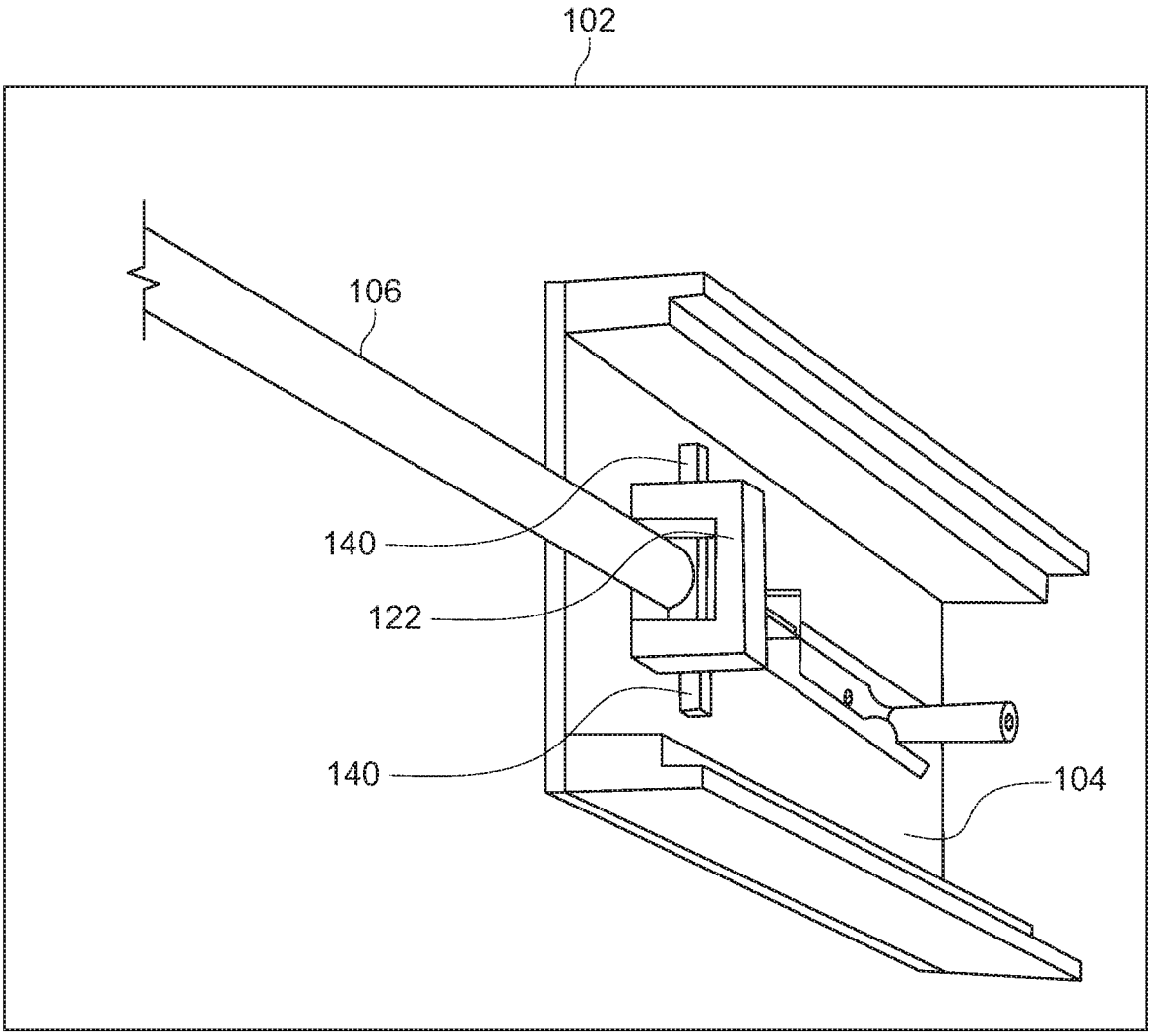
FIG. 6 is the extension rod without the distance barrier in accordance with an exemplary embodiment of the invention.

FIG. 6 illustrates the switch extender device 102 without the distance barrier (not shown) in accordance with an exemplary embodiment of the invention. As shown in FIG. 6, the switch extender device 102 may be utilized by a user slidably engaging or moving the extension rod 106 through the guard rail 122 of the front plate 104 in an up or down manner until the light switch toggles on or off Because of the two or more protruding arms 140, the extension rod 106 stays in position until a user chooses to grip the extension rod 106 and actuate the light switch again.

In another embodiment, the front plate 104 may be decorated with images and/or patterns on the side or the surface visible to the user. In some embodiments, the decoration may include a luminous pattern, signage or a character to facilitate location of the switch extender device 102 in the dark. The signage may be nondigital, digital or any known signage known by those skilled in the art. In other embodiments, the character may be an animal, an object, or a figurine, either real or imaginary, desirable by a child or a user. Additionally, the signage may represent a message when the device switch extender 102 is activated and/or changing actuation states.

In another embodiment, a back plate (not shown) may be used with the front plate to facilitate wall mounting to a light switch. In this configuration, a removable or detachable knock-out portion may be included in the back plate. An opening is included in knock-out portion to accommodate toggle switch. Alternatively, the removal of knock-out portion from the back plate allows the device to be used with a rocker switch.

In some implementations, the device switch extender 102 may be made of one or more of the following device materials: plastic, polymer, carbon fiber, wood, compressed wood, composite wood, masonite, particleboard, aluminum, steel, acrylic, or any known material known by those skilled in the art. The switch extender device 102 may comprise a material composition in the range from 0% to 100% of any the one or more device materials. In an embodiment, the switch extender device 102 may have a material composition mixture of 50% polyester and 4% plastic. In another embodiment, the switch extender device 102 may have a material composition mixture of 50% polymer and 50% masonite.

In another embodiment, the switch extender device 102 may be structured and configured so that excessive force is not applied to either toggle switches or rocker switches when used to avoid damage to the electric switches. Additionally, the components of the switch extender device 102 may be fabricated from durable, wear-resistant polymeric materials or polymer composite materials.

Many different arrangements of the various components depicted, as well as components not shown, are possible without departing from the spirit and scope of the present invention. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A device for extending one or more electric switches comprising:

an extension rod for actuating the electric switches;

a front plate for keeping the extension rod aligned during actuation of the electric switches;

and a fastener portion for securely attaching the front plate to a wall mount plate corresponding to the electric switches, wherein the extension rod has a switch actuator portion that is a single structure to actuate both a rocker switch using a rocker switch interface and a toggle switch using a toggle distance barrier portion, and wherein the switch actuator portion is actuated in an up or down manner until the electric switches toggle on or off.

2. The device of claim 1, wherein the device has a material composition mixture of at least 50% polymer and at least 50% masonite.

3. The device of claim 1, wherein the switch actuator portion includes a hand grip portion.

4. The device of claim 1, wherein the front plate includes a guard rail, and wherein the toggle distance barrier portion has a surface wall barrier with a partial opening to make contact with an elongated aperature covering to prevent the extension rod from falling out of the front plate when the electric switches are actuated.

5. The device of claim 1, wherein the toggle distance barrier portion has at least one side with a mesh surface wall.

6. The device of claim 1, wherein the front plate has at least two apertures.

7. The device of claim 1, wherein the front plate has at least one elongated aperture.

8. An apparatus for extending one or more electric switches comprising:

an extension rod for actuating the electric switches;

a front plate for keeping the extension rod aligned during actuation of the electric switches; and a fastener portion for securely attaching the front plate to a wall mount plate corresponding to the electric switches, wherein the extension rod has a switch actuator portion that is a single structure to actuate both a rocker switch using a rocker switch interface and a toggle switch using a toggle distance barrier portion, and wherein the switch actuator portion is actuated in an up or down manner until the electric switches toggle on or off.

9. The apparatus of claim 8, wherein the fastener portion includes one or more screws.

10. The apparatus of claim 8, wherein the switch actuator portion includes a hand grip portion.

11. The apparatus of claim 8 wherein the front plate includes a guard rail, and wherein the toggle distance barrier portion has a surface wall barrier with a partial opening to make contact with an elongated aperature covering to prevent the extension rod from falling out of the front plate when the electric switches are actuated.

12. The apparatus of claim 8, wherein the apparatus is composed of three different materials selected from this group: plastic, carbon fiber, wood, acrylic, and masonite.

13. A switch actuating device for extending one or more electric switches comprising:

an extension rod for actuating the electric switches;

a front plate for keeping the extension rod aligned during actuation of the electric switches; and a fastener portion for securely attaching the front plate to a wall mount plate corresponding to the electric switches, wherein the extension rod has a switch actuator portion that is a single structure to actuate both a rocker switch using a rocker switch interface and a toggle switch using a toggle distance barrier portion, and wherein the switch actuator portion is actuated in an up or down manner until the electric switches toggle on or off.

14. The switch actuating device of claim 13, wherein the switch actuator portion includes a hand grip portion.

15. The switch actuating device of claim 13, wherein the front plate includes a guard rail.

16. The switch actuating device of claim 13, wherein the device is composed of three different materials selected from this group: plastic, carbon fiber, wood, acrylic, and masonite.

17. The switch actuating device of claim 13, wherein the front plate has at least two apertures.

18. The device of claim 1, wherein the front plate has a decoration that comprises at least two images selected from this group: a luminous pattern, a signage, and a character, wherein the decoration identifies a location of the device in the dark.

19. The device of claim 18, wherein the signage comprises a type selected from this group: digital, and non-digital, and wherein the digital signage represents a message when the device is changing activation states.

* * * * *